US005167288A

United States Patent [19]

McNeil et al.

[11] Patent Number: 5,167,288

[45] Date of Patent: Dec. 1, 1992

[54] ROD DRIVING TOOL

[76] Inventors: Frances B. McNeil; Robert W. McNeil, both of Rte. 3, Box 970, Boones Mill, Va. 24065

[21] Appl. No.: 826,071

[22] Filed: Jan. 27, 1992

[51] Int. Cl.[5] ..... B25D 17/00

[52] U.S. Cl. ..... 173/55; 173/129; 173/132; 254/29 R

[58] Field of Search ..... 173/32, 55, 132, 129; 254/29 R; 29/275

[56] References Cited

U.S. PATENT DOCUMENTS

| | | | |
|---|---|---|---|
| 1,724,814 | 8/1929 | Wolcott | 173/55 |
| 2,310,960 | 2/1943 | Johansen . | |
| 2,874,934 | 2/1959 | Dannehl . | |
| 3,034,588 | 5/1962 | Matheny, Jr. et al. | 173/129 |
| 3,709,464 | 1/1973 | Johnson et al. | 254/29 R |
| 4,641,715 | 2/1987 | Stinson et al. | 173/132 |
| 4,776,407 | 10/1988 | Kostylev et al. | 173/55 |
| 5,010,710 | 4/1991 | Gray et al. . | |

*Primary Examiner*—Frank T. Yost
*Assistant Examiner*—Scott A. Smith
*Attorney, Agent, or Firm*—Richard C. Litman

[57] ABSTRACT

A tool comprising a temporary attachment to a rod being driven into the ground. The tool has jaws to grip the rod and has a pressure or impact receiving surface so a kelly bar may be brought to bear on the attachment. The jaws hold the rod coaxially with the kelly bar so that application of pressure does not bias the rod, possibly causing the rod to bend or to enter the ground at an unintended angle. An extension of the frame of the attachment coaxially penetrates the kelly bar to assure alignment therebetween. The jaws are spring biased to relax the grip on the bar, and are automatically repositioned on the rod upon each successive application of force by the kelly bar. An attached chain provides a lifting handle.

6 Claims, 3 Drawing Sheets

ROD DRIVING TOOL

FIELD OF THE INVENTION

The present invention relates to an attachment for ground rods and the like, and more particularly to an attachment which is used with heavy equipment having a kelly bar in driving ground rods into the ground.

DESCRIPTION OF THE PRIOR ART

Attachments facilitating driving of ground rods and the like are known, as exemplified by U.S. Pat. No. 5,010,710, issued to Daniel W. Gray et al. on Apr. 30, 1991. This patent is intended for use with jack hammers, but could be used with heavy equipment having a kelly bar. Gray et al. provide an attachment that grips the ground rod and provides a platform on which the jack hammer or other source of pressure bears.

U.S. Pat. Nos. 2,310,960, issued to Harry C. Johansen on Feb. 16, 1943, and 2,874,934, issued to Melvin A. Dannehl on Feb. 24, 1959, disclose chucks or other gripping devices for pushing rod stock into the ground. Johansen's device is far more complicated than the present invention. Dannehl's gripping device does not work with a vertically acting, unidirectional source of pressure.

None of the above inventions and patents, taken either singly or in combination, is seen to describe the instant invention as claimed.

SUMMARY OF THE INVENTION

The present invention provides an attachment comprising a gripping device used in combination with a conventional kelly bar driven by hydraulic equipment to drive a ground rod or the like into the ground. The invention combines spring biased gripping of the rod; coaxial arrangement of the rod with the platform receiving pressure from the kelly bar; a guide that cooperates with the kelly bar to assure coaxial alignment therebetween, and a multi-jaw chuck which assures coaxial alignment of the rod with the inventive attachment.

A return spring restores the attachment to a "ready" position with respect to the ground rod upon the kelly bar being raised for the next down stroke. Thus, no user's intervention is required, and the attachment is fully automatic.

Accordingly, an object of the present invention is to provide a rod driving attachment having substantially coaxial alignment of the kelly bar, the rod, and the jaws of the attachment.

A second object is to provide a rod driving attachment having an extension concentric to and overlapping a kelly bar.

A third object is to provide a rod driving attachment which is fully automatic, requiring only operation of a kelly bar.

Another object is to provide a rod driving attachment wherein the jaws define a line of contact parallel to the rod.

Yet another object is to provide a rod driving attachment wherein the jaws are biased to grip the rod by operation of a kelly bar.

Still another object is to provide a rod driving attachment wherein increased driving pressure further increases the grip of the jaws. An additional object is to provide a rod driving attachment having an automatically released grip of the jaws on the rod upon removal of pressure by a kelly bar.

A further object is to provide a rod driving attachment having rugged and uncomplicated construction.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figures 1, 2:
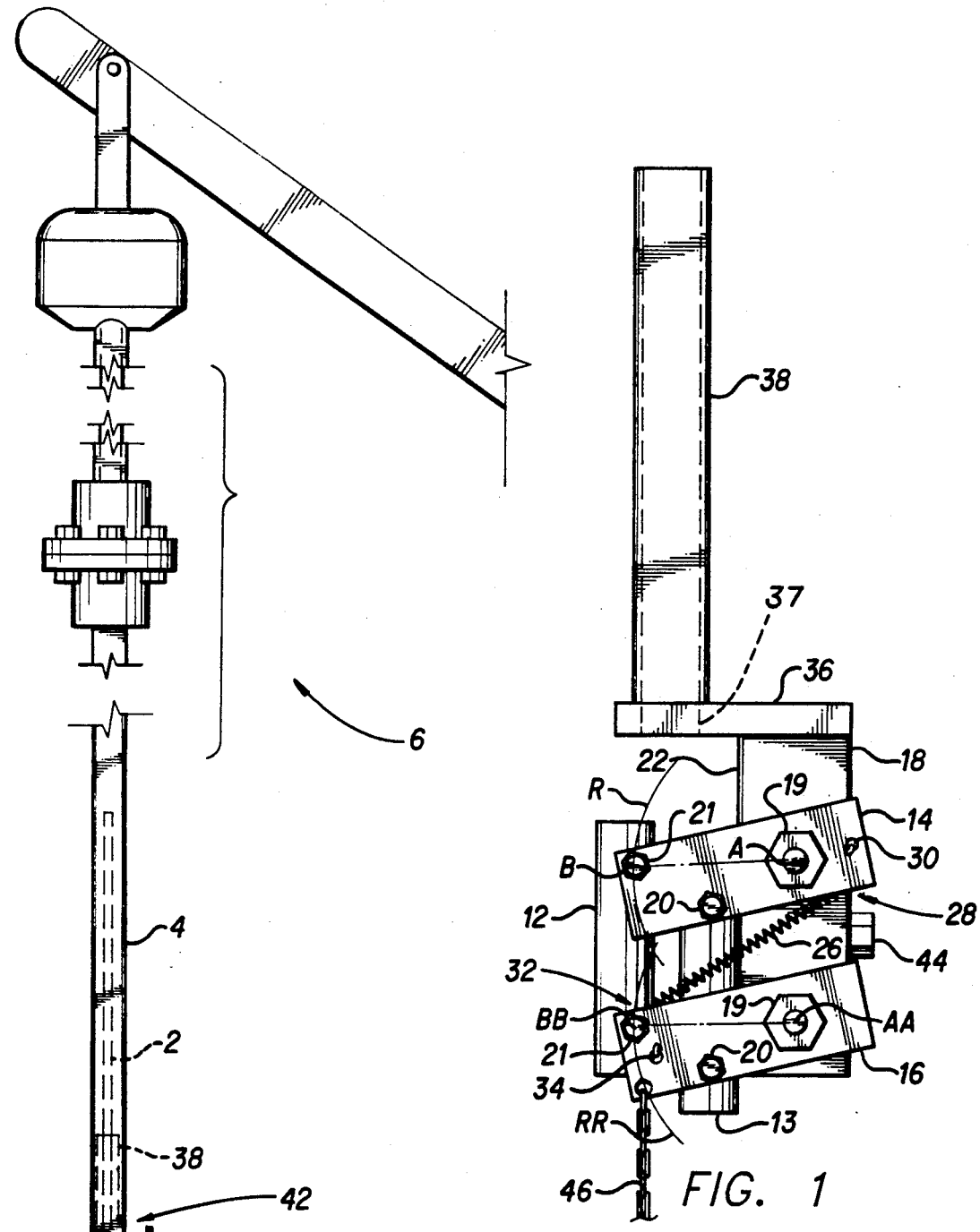
FIG. 1 is a side elevational view of the attachment.
FIG. 2 is a side elevational view of the attachment in its environment, drawn to reduced scale.
Figure 4:
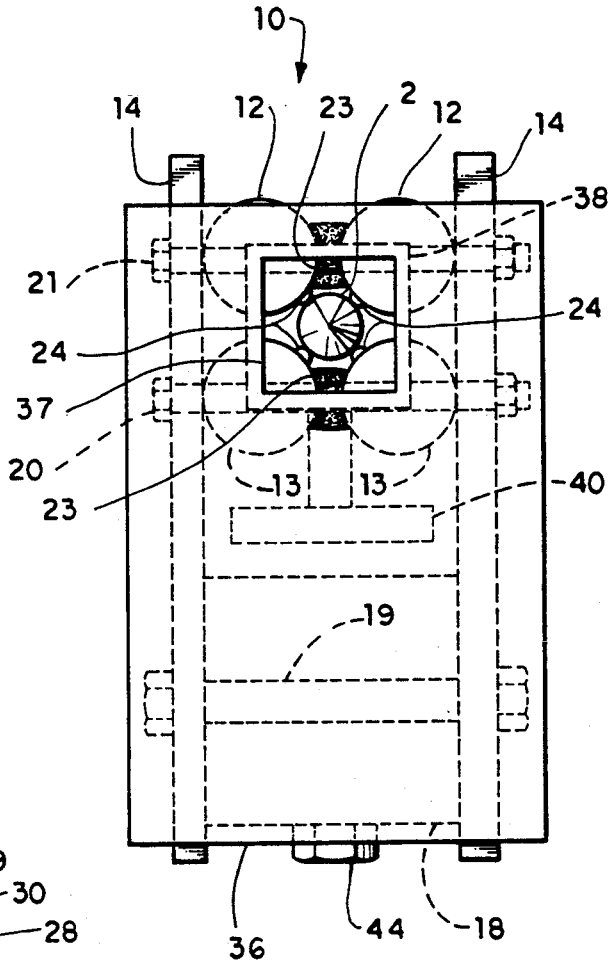
FIG. 4 is a top plan view of the attachment.
Figure 5:
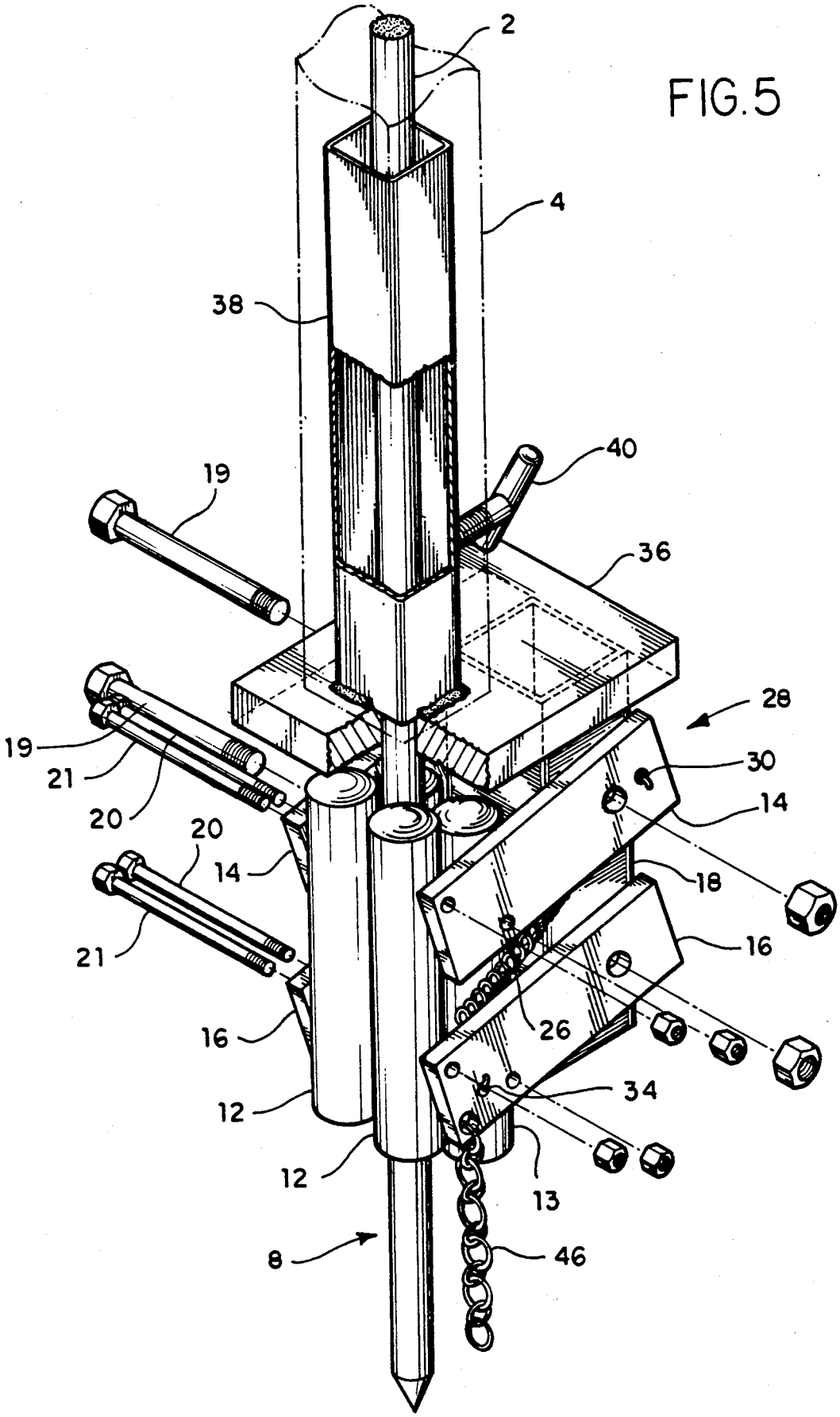
FIG. 5 is a partially exploded perspective view of the attachment.

The present invention is seen in FIGS. 4 and 5 to comprise an attachment 10 for driving a ground rod 2 into the ground, including four parallel annular gripping members 12, 13 pivotally supported on two upper and two lower swing arms 14, 16 pivotally mounted to a solid metal frame 18. Bolt and nut assemblies 19, 20, 21 both retain the swing arms 14, 16 and gripping members 12, 13 on frame 18, and also define axes A, AA, B, BB about which the swing arms 14, 16 and gripping members 12, 13 pivot, seen more clearly in FIG. 1. The gripping members 12, 13 are constrained to maintain parallel orientation with respect to a front face 22 of the frame 18 since, as seen in FIG. 1, the arcs R, RR of swing of the upper and lower swing arms 14, 16 are equal. The arcs R, RR are defined by the respective pivot axes A, AA at the frame 18 and outer axes B, BB at the outer gripping members 12.

It is to be understood that the present invention is substantially bilaterally symmetrical, and that there are right and left gripping members 12, 13 and swing arms 14, 16. This is shown more clearly in FIGS. 4 and 5.

Gripping members 12, 12 may be welded to one another, just as gripping members 13, 13 may be, to relieve strain tending to separate each welded pair of gripping members 12, 12 and 13, 13 as a rod 2 is more tightly gripped. Weldments 23 are best seen in FIG. 4.

Figure 3:
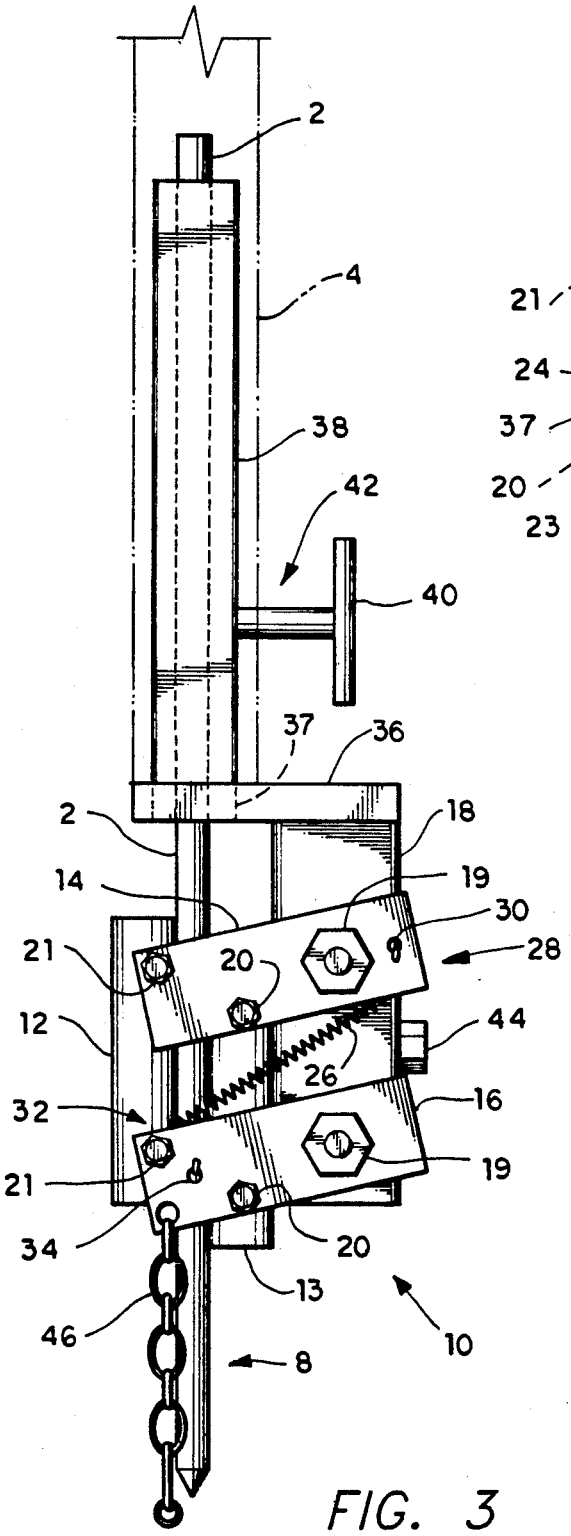
FIG. 3 is a detail of FIG. 2, drawn to enlarged scale.

As shown in FIGS. 3 and 4, a ground rod 2 is held in a central position located among the gripping members 12, 13. Cleats 24, provided by a raised, roughened surface formed on the inside of each of the gripping members 12, 13, and provided by a welding bead, improve adhesion between the gripping members 12, 13 and the rod 2. The cleats 24 are shown in FIG. 4.

The geometry of the attachment 10 will now be discussed. As seen in FIG. 1, outer gripping members 12 are held at parallel, horizontal radii extending from the pivot axes A, AA of the swing arms 14, 16 on the frame 18 to the outer axes B, BB at bolts 21 penetrating the outer gripping members 12, respectively. Inner gripping members 13 are held intermediate the frame 18 and the outer gripping members 12, using the same pivot axes A, AA at the frame 18. Bolts 20 penetrating the inner gripping members 13 define shorter arcs of swing (not illustrated). As the swing arms 14, 16 swing upwardly, and thus depart from the orientation with respect to the front face 22 of the frame 18 as viewed in FIG. 1, the outer gripping members 12 are moved toward the front face 22 of the frame 18 to a greater extent than are the inner gripping members 13. The inner and outer gripping members 12, 13 thus move closer relative to each other. This motion provides adjustment for holding rods 2 of different diameter, and, once contact is made between the gripping members 12, 13 and a rod 2, the grip of the attachment 10 on the rod 2 increases. Conversely, motion returning the swing arms 14, 16 to the perpendicular orientation discussed above will relax the grip of the attachment 10 on a rod 2.

A spring 26 anchored at a proximal end 28 to a hole 30 located in an upper swing arm 14 and anchored at a distal end 32 to a hole 34 disposed within the lower swing arm 16 biases the swing arms 14, 16 to swing towards the orientation discussed above, thus tightening the gripping members 12, 13 against the rod 2. When the kelly bar 4 is raised in preparation for a subsequent down stroke, the attachment 10 relaxes its hold on the rod 2 and is carried with the kelly bar 4 to a new, higher location on the rod 2. Therefore, the attachment 10 operates automatically, not being dependent upon a user for repositioning for each stroke.

The frame 18 has an upper, horizontal mounting plate 36 with an opening 37 for a hollow extension 38 which projects upwardly therefrom in a position substantially coaxial with the rod 2, as best shown in FIGS. 1, 3 and 5. The extension 38 is inserted within the kelly bar 4, and serves to align the attachment 10 therewith. A setscrew 40 is screwed into a threaded hole 42 in the kelly bar 4 to secure the attachment 10 and rod 2 thereto. This setscrew 40 is carried on the attachment 10 when not in service by screwing into a holding nut 44 (see FIGS. 1, 3 and 4) adhered to the frame 18.

When the attachment 10 is secured to a kelly bar 4, held by heavy equipment 6, the rod 2 is inserted into the attachment 10 with a short section 8 of the rod 2 exposed. Pressure is brought to bear on the central section 36 of the frame 18 by the kelly bar 4, which pressure drives the rod 2 into the ground the distance of its exposed section 8. The spring 26 then urges the swing arms 14, 16 towards an orientation such that the gripping members 12, 12 are slightly spread from the gripping members 13, 13. The grip of the attachment 10 on the rod 2 is thus relaxed, permitting relocation of the attachment 10 higher on the rod 2. The rod 2 is subjected to repeated cycles of pressure and relocation of the attachment 10, progressively driving the rod 2 into the ground in incremental steps. The attachment 10 is then disengaged from the rod 2 and from the kelly bar 4 when the rod 2 is driven sufficiently deep. Release chain 46 is used as a handle to manually shift gripping members 12 and 13 to a disengaged position against the bias of spring 26 as shown in FIGS. 1, 2, 3 and 5 when loading a rod 2 into attachment 10. Chain 46 also provides a convenient handle for carrying attachment 10 when attachment 10 is not being used.

It is to be understood that the present invention is not limited to the sole embodiment described above, but encompasses any and all embodiments within the scope of the following claims.

We claim:

1. A rod driving tool usable with a kelly bar, comprising:

a solid metal frame having a planar front face, planar side walls, a planar rear wall, and a mounting plate disposed in a plane perpendicular to said planar front face, planar side walls and planar rear wall, said mounting plate having a portion extending beyond said planar front face with an opening therethrough;

a hollow extension disposed perpendicular to said extending portion, locatable within said kelly bar and coaxial with said opening;

means for connecting said hollow extension to said kelly bar;

a pair of upper swing arms pivotally mounted respectively, at a proximal end on said planar side walls;

a pair of lower swing arms pivotally mounted respectively at a proximal end on said planar side walls;

a pair of inner gripping members disposed parallel to said planar front face of said frame and pivotally connected to said upper and lower swing arms at a medial portion of said arms;

a pair of outer gripping members disposed parallel to said pair of inner gripping members and pivotally connected to distal ends of said upper and lower swing arms;

cleats provided on said inner and outer gripping members to engage a rod located centrally of said inner and outer gripping members so as to guide and grip said rod; and spring means connecting said upper and lower swing arms so as to bias said outer gripping members towards said inner gripping members; whereby said inner and outer gripping members will tightly grip said rod to drive said rod when said kelly bar is driven in one direction, and will release said rod when said kelly bar is driven in a second direction.

2. A rod driving tool as in claim 1, wherein:

said rod is disposed coaxially within said hollow extension when loaded into said rod driving tool; and said cleats are circumferentially located at 90 degree intervals around said rod; whereby said rod is uniformly guided by said rod driving tool during a driving operation.

3. A rod driving tool as in claim 1, wherein said spring means are respectively connected to the proximal end of said upper swing arms and the distal end of said lower swing arms.

4. A rod driving tool as in claim 1, wherein:

said connecting means comprising bolt means connecting said hollow extension to said kelly bar; and a holding nut mounted on said planar rear wall of said solid metal frame 18; whereby said bolt means may be stored when said rod driving tool is disconnected from said kelly bar.

5. A rod driving tool as in claim 1, wherein:

said inner gripping members and said outer gripping members are cylinders respectively connected by welds; and said inner gripping members travel along a smaller arc than said outer gripping members.

6. A rod driving tool as in claim 1, further comprising a release chain forming a handle for releasing said inner and outer gripping means during loading of said rod into said tool and for carrying said tool when said tool is not being used.

* * * * *